US010612393B2

(12) United States Patent
Snider et al.

(10) Patent No.: US 10,612,393 B2
(45) Date of Patent: Apr. 7, 2020

(54) SYSTEM AND METHOD FOR NEAR WALL COOLING FOR TURBINE COMPONENT

(71) Applicant: General Electric Company, Schenectady, NY (US)

(72) Inventors: Zachary John Snider, Simpsonville, SC (US); Allison Christine Gose, Ann Arbor, MI (US); Daniel Burnos, Greenville, SC (US); Gregory Thomas Foster, Greer, SC (US)

(73) Assignee: General Electric Company, Schenectady, NY (US)

( * ) Notice: Subject to any disclaimer, the term of this patent is extended or adjusted under 35 U.S.C. 154(b) by 309 days.

(21) Appl. No.: 15/624,269

(22) Filed: Jun. 15, 2017

(65) Prior Publication Data

US 2018/0363471 A1 Dec. 20, 2018

(51) Int. Cl.

*F01D 5/18* (2006.01)
*F01D 9/02* (2006.01)
*F01D 25/12* (2006.01)

(52) U.S. Cl.

CPC ..... *F01D 5/187* (2013.01); *F01D 9/02* (2013.01); *F01D 25/12* (2013.01); *F05D 2220/32* (2013.01); *F05D 2230/237* (2013.01); *F05D 2250/185* (2013.01); *F05D 2260/201* (2013.01); *F05D 2260/202* (2013.01)

(58) Field of Classification Search

CPC ..... F01D 5/186; F01D 5/187; F01D 5/188; F01D 9/02; F01D 25/12

See application file for complete search history.

(56) References Cited

U.S. PATENT DOCUMENTS

| | | | | |
|---|---|---|---|---|
| 4,411,597 | A * | 10/1983 | Koffel | B23P 6/005 416/224 |
| 5,340,274 | A | 8/1994 | Cunha | |
| 6,454,526 | B1 * | 9/2002 | Cunha | F01D 5/147 415/115 |
| 8,628,294 | B1 * | 1/2014 | Liang | F01D 5/187 415/115 |
| 8,870,524 | B1 * | 10/2014 | Liang | F01D 9/065 415/115 |
| 9,581,028 | B1 * | 2/2017 | Jones | F01D 5/18 |
| 2014/0060084 | A1 * | 3/2014 | Gregg | F01D 5/188 60/806 |

(Continued)

OTHER PUBLICATIONS

U.S. Appl. No. 15/621,473, filed Jun. 13, 2007, Leary et al.

*Primary Examiner* — Sizo B Vilakazi
*Assistant Examiner* — Anthony L Bacon
(74) *Attorney, Agent, or Firm* — Fletcher Yoder, P.C.

(57) ABSTRACT

A turbine airfoil includes a turbine component that includes a leading edge, a trailing edge, a pressure side wall extending between the leading edge and the trailing edge, a suction side wall extending between the leading edge and the trailing edge, a near wall source cavity disposed within the turbine component, and the near wall source cavity receives cooling air, and a second near wall cooling cavity disposed within the turbine component. The turbine airfoil further includes a first circuit completion plate disposed on a first end of the turbine component, and the first circuit completion plate fluidly couples the near wall source cavity to the second near wall cooling cavity.

20 Claims, 4 Drawing Sheets

(56) References Cited

U.S. PATENT DOCUMENTS

| | | | | |
|---|---|---|---|---|
| 2014/0079540 | A1* | 3/2014 | Morris | B22F 3/1055 415/178 |
| 2016/0076384 | A1* | 3/2016 | Snyder | F01D 9/02 415/115 |
| 2017/0167269 | A1* | 6/2017 | Itzel | F01D 5/187 |
| 2017/0248023 | A1* | 8/2017 | Bluck | F01D 5/081 |
| 2017/0328211 | A1* | 11/2017 | Leary | F01D 5/186 |
| 2018/0051577 | A1* | 2/2018 | Leary | F01D 5/187 |
| 2018/0066523 | A1* | 3/2018 | Marsh | F01D 5/187 |
| 2018/0066525 | A1* | 3/2018 | Downs | F01D 5/187 |
| 2018/0073369 | A1* | 3/2018 | Lewis | F04D 29/582 |
| 2018/0135445 | A1* | 5/2018 | Surace | F01D 9/042 |
| 2018/0223676 | A1* | 8/2018 | Spangler | F01D 5/189 |

* cited by examiner

SYSTEM AND METHOD FOR NEAR WALL COOLING FOR TURBINE COMPONENT

BACKGROUND

The subject matter disclosed herein relates to combustion turbine systems, and more specifically, to combustor and turbine sections of combustion turbine systems.

In a combustion turbine, fuel is combusted in a combustor section to form combustion products, which are directed to a turbine section. The components of the turbine of the turbine section expend the combustion products to drive a load. The combustion products pass through the turbine section at high temperatures. Reducing the surface temperature of the components of the turbine may allow for greater efficiency of the turbine section.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In one embodiment, a turbine airfoil includes a turbine component that includes a leading edge, a trailing edge, a pressure side wall extending between the leading edge and the trailing edge, a suction side wall extending between the leading edge and the trailing edge, a near wall source cavity disposed within the turbine component, and the near wall source cavity receives cooling air, and a second near wall cooling cavity disposed within the turbine component. The turbine airfoil further includes a first circuit completion plate disposed on a first end of the turbine component, and the first circuit completion plate fluidly couples the near wall source cavity to the second near wall cooling cavity.

In another embodiment, a turbine airfoil includes a turbine component that includes a leading edge, a trailing edge, a pressure side wall extending between the leading edge and the trailing edge, and a suction side wall extending between the leading edge and the trailing edge. The turbine component further includes a pressure side near wall source cavity disposed within the turbine component, and the pressure side near wall source cavity receives cooling air. In addition, the turbine component includes a second pressure side near wall cooling cavity disposed within the turbine component, and the pressure side near wall source cavity and the second pressure side near wall cooling cavity are adjacent to the pressure side wall. Moreover, the turbine component includes a suction side near wall source cavity disposed within the turbine component, and the suction side near wall source cavity receives cooling air. The turbine component also includes a second suction side near wall cooling cavity disposed within the turbine component, and the suction side near wall source cavity and the second suction side near wall cooling cavity are adjacent to the suction side wall. Further, the turbine airfoil includes a circuit completion plate disposed on a first end of the turbine component, and the circuit completion plate fluidly couples the pressure side near wall source cavity to the second pressure side near wall cooling cavity and the suction side near wall source cavity to the second suction side near wall cooling cavity.

In a further embodiment, a turbine airfoil includes a turbine component that includes a leading edge, a trailing edge, a pressure side wall extending between the leading edge and the trailing edge, and a suction side wall extending between the leading edge and the trailing edge. The turbine component also includes a near wall source cavity disposed within the turbine component, and the near wall source cavity is configured to receive cooling air, a second near wall cooling cavity disposed within the turbine component, a third near wall cooling cavity disposed within the turbine airfoil, and a fourth near wall cooling cavity disposed within the airfoil. In addition, the turbine airfoil includes a first circuit completion plate disposed on a first end of the turbine component, and the first circuit completion plate fluidly couples the near wall source cavity to the second near wall cooling cavity and the third near wall cooling cavity to the fourth near wall cooling cavity. Moreover, the turbine airfoil includes a second circuit completion plate disposed on a second end of the turbine component opposite the first end and the second circuit completion plate fluidly couples the second near wall cooling cavity to the third near wall cooling cavity. Further, the cooling air flows through the near wall source cavity, the second near wall cooling cavity, the third near wall cooling cavity, and the fourth near wall cooling cavity in a serpentine path.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

Combustion products (e.g. exhaust gas) directed from a combustor to a turbine may pass through the turbine at a high temperature. The temperature of the combustion products may be high enough to reduce the structural integrity of certain elements (e.g., metals with a low melting point). However, increasing the temperature of the combustion products may increase the efficiency of the combustion turbine system (e.g., gas turbine system). Therefore, it is desirable to provide a cooling system to the components of the turbine. Increasing the efficiency of a cooling system may cause a reduction in the amount of coolant flow which may cause an increase in the efficiency of the turbine.

Accordingly, embodiments of the present disclosure generally relate to a system and method for cooling the components (e.g., turbine airfoil) of the combustion turbine system. That is, some embodiments include passages (e.g., serpentine passages) in the body (e.g., near wall) of the components that enables air to flow through. These passages may also include openings on the surface of the components such that the air flowing into the passages may flow out of the components through the openings. The air flow through the passages may provide cooling (e.g., convective cooling) to the internal structure of the components. The air flow through the openings may provide a thin film of air on the outside surface of the components that provides cooling to the outside surface of the components.

Figure 1:
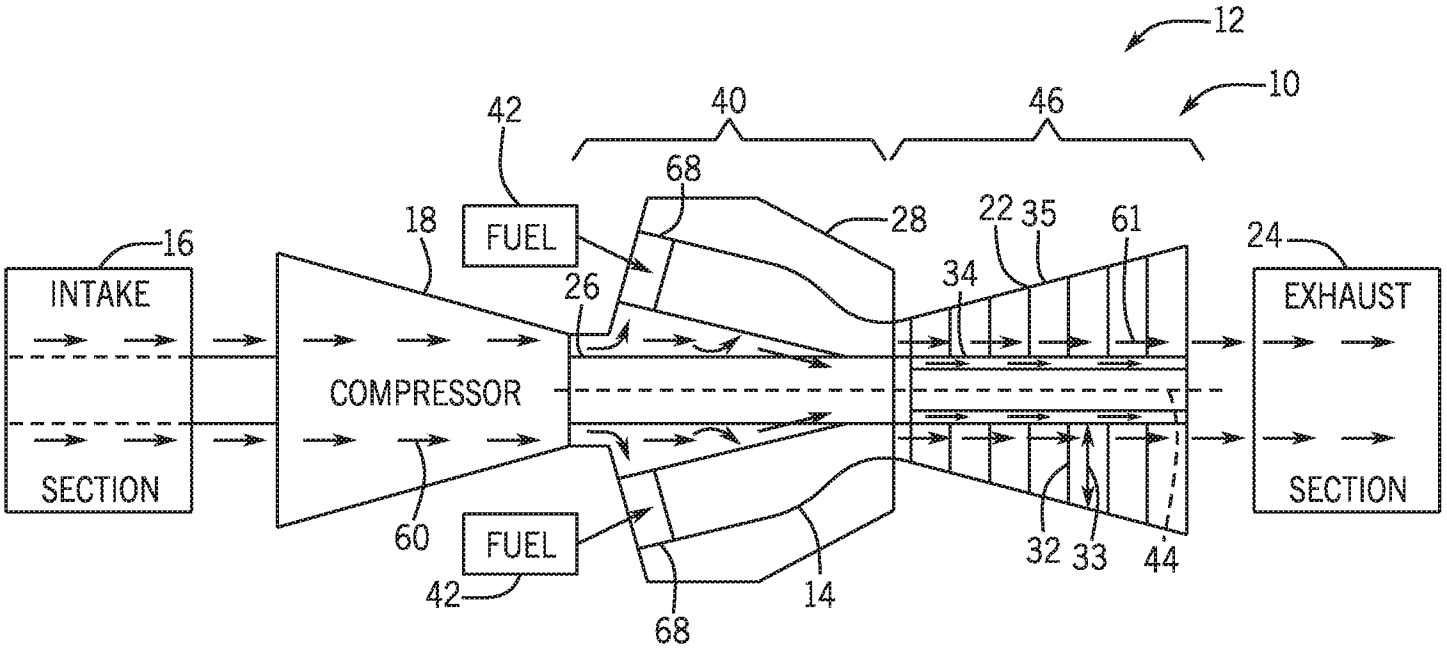
FIG. 1 is a diagram of an embodiment of a gas turbine system.

With the foregoing in mind, FIG. 1 is a block diagram of an example of a gas turbine system 10 that includes a gas turbine engine 12 having a combustor 14 and a turbine 22. In certain embodiments, the gas turbine system 10 may be all or part of a power generation system. In operation, the gas turbine system 10 may use liquid or gas fuel 42, such as natural gas and/or a hydrogen-rich synthetic gas, to run the gas turbine system 10. In FIG. 1, oxidant 60 (e.g. air) enters the system at an intake section 16. The compressor 18 compresses oxidant 60. The oxidant 60 may then flow into compressor discharge casing 28, which is a part of a combustor section 40. The oxidant 60 may also flow from the compressor discharge casing 28 into the turbine 22 through a passage 34 disposed about a shaft 26 or another passage that allows flow of the oxidant 60 to the turbine 22. The combustor section 40 includes the compressor discharge casing 28 and the combustor 14.

Fuel nozzles 68 inject fuel 42 into the combustor 14. For example, one or more fuel nozzles 68 may inject a fuel-air mixture into the combustor 14 in a suitable ratio for desired combustion, emissions, fuel consumption, power output, and so forth. The oxidant 60 may mix with the fuel 42 in the fuel nozzles 68 or in the combustor 14. The combustion of the fuel 42 and the oxidant 60 may generate the hot pressurized exhaust gas (e.g., combustion products 61). The combustion products 61 pass into the turbine 22. The combustor section 40 may have multiple combustors 14. For example, the combustors 14 may be disposed circumferentially about a turbine axis 44. Embodiments of the gas turbine engine 12 may include 1, 2, 3, 4, 5, 6, 7, 8, 9, 10, 11, or 12 or more combustors 14.

A turbine section 46 includes the turbine 22 that receives the combustion products 61 and turbine components 32 (e.g., turbine airfoils, turbine blades, or turbine nozzles). The turbine components 32 are coupled to the shaft 26 and extend towards a turbine casing 35 with a height 33. The combustion products 61 may drive one or more turbine components 32 within the turbine 22. For example, the combustion products 61 (e.g., the exhaust gas) flowing into and through the turbine 22 may flow against and between the turbine components 32, thereby driving the turbine components 32 into rotation. Because the turbine components 32 are coupled to the shaft 26 of the gas turbine engine 12, the shaft 26 also rotates. In turn, the shaft 26 drives a load, such as an electrical generator in a power plant. The shaft 26 lies along the turbine axis 44 about which turbine 22 rotates. The combustion products 61 exit the turbine 22 through an exhaust section 24.

Figure 2:
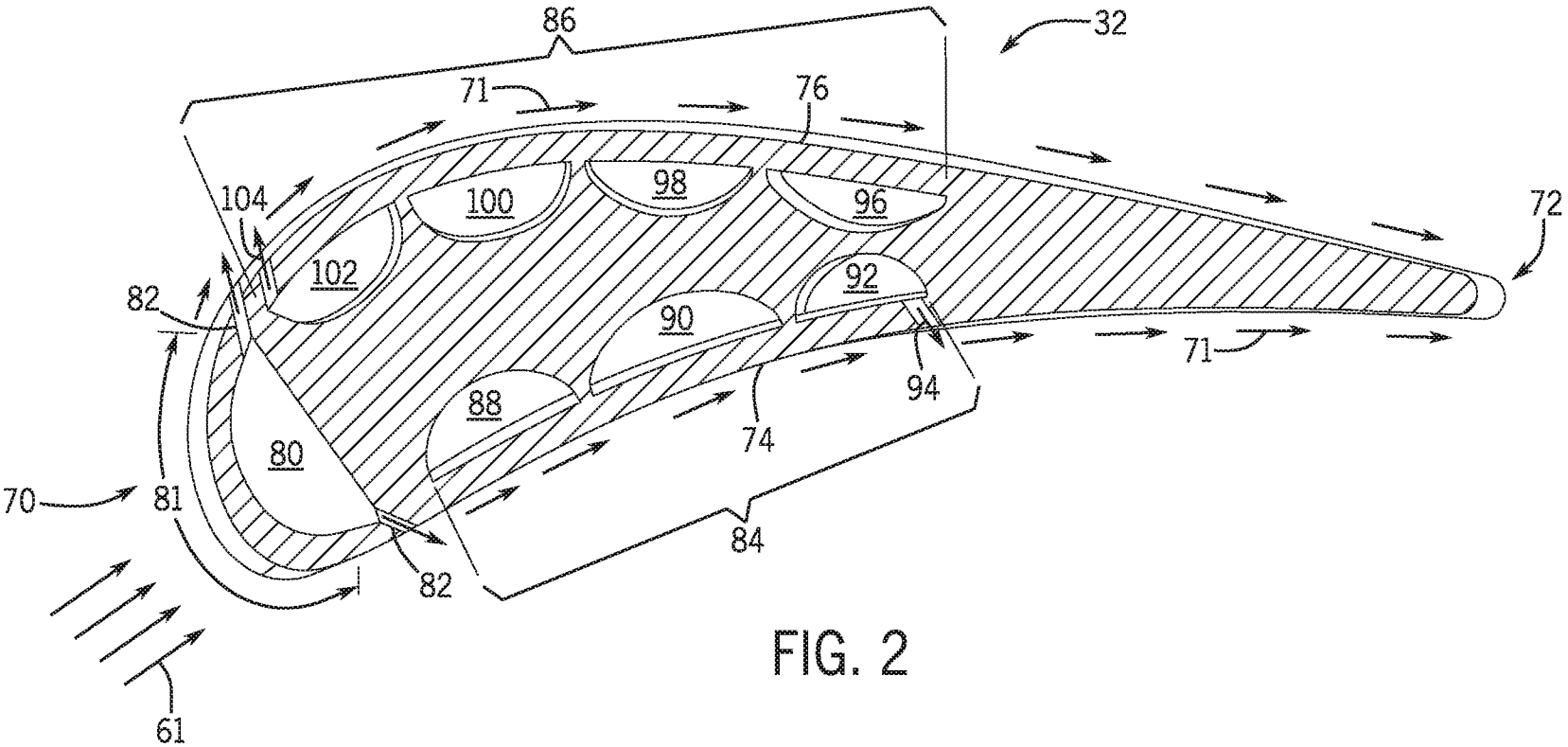
FIG. 2 is a cross-sectional view of an embodiment of a turbine component of the gas turbine system of FIG. 1.

FIG. 2 is a cross-sectional view of an embodiment of one of the turbine components 32 (e.g., turbine airfoils) in the turbine section of FIG. 1. As discussed above, the combustion products 61 flow against the turbine component 32 to drive the turbine component 32 into rotation. In operation, the combustion products 61 flow against the turbine component 32 from a leading edge 70 to a trailing edge 72. The flow of the combustion products 61 along with the airfoil shape of the turbine component 32 causes a pressure gradient across the turbine component 32. For example, the pressure along a pressure side wall 74 that extends from the leading edge 70 to the trailing edge 72 is higher than the pressure along a suction side wall 76 that extends from the leading edge 70 to the trailing edge 72.

As the combustion gases 61 pass over the turbine component 32, the combustion gases 61 transfer a portion of the heat to the turbine component 32. Accordingly, the turbine component 32 may utilize various structures and methods to dissipate the heat received from the combustion gases 61. In the present embodiment, thin film cooling is utilized to reduce the transfer of the heat of the combustion gases 61 to the turbine component 32. Thin film cooling is the process of providing cool air (e.g., the oxidant from the compressor discharge casing) to the surface of the turbine component 32. The cool air may be provided such that the cool air envelopes the surface of the turbine component 32 and travels along a thin film cooling path 71. Further, the flow of the combustion gases 61 may disrupt this thin film of cool air and techniques described in detail below may maintain the thin film of cool air.

For example, the turbine component 32 may include diffuser holes along a leading edge section 78. Diffuser holes are small holes formed in the surface of the turbine component 32, for example along a leading edge section 81. The diffuser holes allow air to pass through in the form of 'jets' and provide a higher rate of convective heat transfer through impingement. In the present embodiment, the diffuser holes allow air to flow from outside the turbine component 32 into an impingement cavity 80. The air flowing through the diffuser holes and into the impingement cavity 80 may include some of the cool air that forms the thin film and provide cooling to the surface and internal structure of the turbine component 32. After the air flows into the impingement cavity 80, the air may flow out of the impingement cavity 80 through one or more holes that may allow the air to flow along thin film entrance paths 82 and into the thin film path 71. Accordingly, the impingement cavity 80 extends, internal to the turbine component 32, along the leading edge section 81 of the leading edge 70 and towards the trailing edge 72. Air that flows through the diffuser holes may still be at a temperature lower than the combustion gases 61 and thus are still capable of providing cooling to the turbine component 32. Allowing the air to flow out of the impingement cavity 80 along the thin film entrance paths 82 may provide cooling to the pressure side wall 74, the suction side wall 76, or both and may maintain the thin film along the surface of the turbine component 32.

In the present embodiment, the turbine component 32 employs further structure to provide cooling. For example, the turbine component 32 includes a set of pressure side cooling cavities 84 and a set of suction side cooling cavities 86. The set of pressure side cooling cavities 84 are located near the pressure side wall 74, and the set of suction side cooling cavities 86 are near the suction side wall 76. Further, both the set of pressure side cooling cavities 84 and the set of suction side cooling cavities 86 provide near wall cooling to the respective side walls. Both the set of pressure side cooling cavities 84 and the set of suction side cooling cavities 86 include multiple cavities that may be fluidly coupled to one another. For example, the cavities of the set of pressure side cooling cavities 84 may be fluidly coupled to one another, and the cavities of the set of suction side cooling cavities 86 may be fluidly coupled to one another. Further, the cavities of the pressure side cooling cavities 84 may be fluidly coupled or fluidly separate from the cavities of the set of suction side cooling cavities 86.

In the present embodiment, the set of pressure side cooling cavities 84 includes three cooling cavities fluidly coupled to one another. As the air flows through the set of pressure side cooling cavities 84, the air flows in a serpentine pattern (e.g., a serpentine path). Further, the fluid coupling of the cooling cavities enables the air to flow through an end wall section of the turbine component 32 from one cooling cavity to another. In other embodiments, the set of pressure side cooling cavities 84 may include more or fewer cavities, including 1, 2, 4, 5, 6, or more. Further, each of the cavities of the set of pressure side cooling cavities 84 may be fluidly coupled to each other, fluidly coupled to only some of the other cavities, fluidly separate from one another, or any combination thereof.

In the illustrated embodiment, a pressure side near wall source cavity 88 receives cool air (e.g., the oxidant from the compressor discharge casing) via a channel in the base of the turbine component 32. The cool air flows through the pressure side near wall source cavity 88 and cools the pressure side wall 74 through a combination of convective and conductive cooling. Then, the air flows through a second pressure side near wall cooling cavity 90 and a third pressure side near wall cooling cavity 92. Then, the air flows out of the set of pressure side cooling cavities 84 either to join the thin film cooling path 71 or through the base of the turbine component 32 to be sent to other portions of the gas turbine system. The cool air may join the thin film cooling path 71 by flowing through holes disposed along the pressure side wall 74 that fluidly couple one of the cavities of the set of pressure side wall cooling cavities 84 to the space outside of the turbine component 32 through which the combustion gases 61 flow. For example, the cool air may flow along a path 94 to exit the second pressure side cooling cavity 92 to an outer surface of the turbine component 32 to join the thin film cooling path 71. Further, each of the cooling cavities of the set of pressure side cooling cavities 84 extends vertically along the height of the turbine component 32 into and out of the page.

As depicted, the pressure side near wall source cavity 88 is disposed closer to the leading edge 70 relative to the second pressure side near wall cooling cavity 90 and the third pressure side near wall cooling cavity 92. Further, the pressure side near wall source cavity 88 is the only cavity of the set of pressure side cooling cavities 84 to receive cool air from another portion (e.g., the compressor discharge casing) of the gas turbine system. In other embodiments, any combination of the pressure side near wall source cavity 88, the second pressure side near wall cooling cavity 90, and the third pressure side near wall cooling cavity 92 may receive cool air from another portion of the gas turbine system.

In the present embodiment, the set of suction side cooling cavities 86 includes four cooling cavities fluidly coupled to one another. As the air flows through the set of pressure side cooling cavities 84, the air flows in a serpentine pattern. Further, the fluid coupling of the cooling cavities enables the air to flow through an end wall section of the turbine component 32 from one cooling cavity to another. In other embodiments, the set of suction side cooling cavities 86 may include more or fewer cavities, including 1, 2, 3, 5, 6, or more. Further, each of the cavities of the set of suction side cooling cavities 86 may be fluidly coupled to each other, fluidly coupled to only some of the other cavities, fluidly separate from one another, or any combination thereof.

In the illustrated embodiment, a suction side near wall source cavity 96 receives cool air (e.g., the oxidant from the compressor discharge casing) via a channel in the base of the turbine component 32. The cool air flows through the suction side near wall source cavity 96 and cools the suction side wall 76 through a combination of convective and conductive cooling. Then, the air flows through a second suction side near wall cooling cavity 98, a third suction side near wall cooling cavity 100, and a fourth suction side near wall cooling cavity 102. Then, the air flows out of the set of suction side cooling cavities 86 either to join the thin film cooling path 71 or through the base of the turbine component 32 to be sent to other portions of the gas turbine system. The cool air may join the thin film cooling path 71 by flowing through holes disposed along the suction side wall 76 that fluidly couple any combination of the cavities of the set of suction side wall cooling cavities 86 to the space outside of the turbine component 32 through which the combustion gases 61 flow. For example, the cool air may flow along a path 104 to exit the fourth suction side near wall cooling cavity 102 to an outer surface of the turbine component 32 to join the thin film cooling path 71. Further, each of the cooling cavities of the set of suction side cooling cavities 86 extends vertically along the height of the turbine component 32 into and out of the page.

As depicted, the suction side near wall source cavity 96 is disposed closer to the trailing edge 72 relative to the second suction side near wall cooling cavity 98, the third suction side near wall cooling cavity 100, and the fourth suction side near wall cooling cavity 102. Further, the suction side near wall source cavity 96 is the only cavity of the set of suction side cooling cavities 86 to receive cool air from another portion (e.g., the compressor discharge casing) of the gas turbine system. In other embodiments, any combination of the suction side near wall source cavity 96, the second suction side near wall cooling cavity 98, the third suction side near wall cooling cavity 100, and the fourth suction side near wall cooling cavity 102 may receive cool air from another portion of the gas turbine system.

Figure 3:
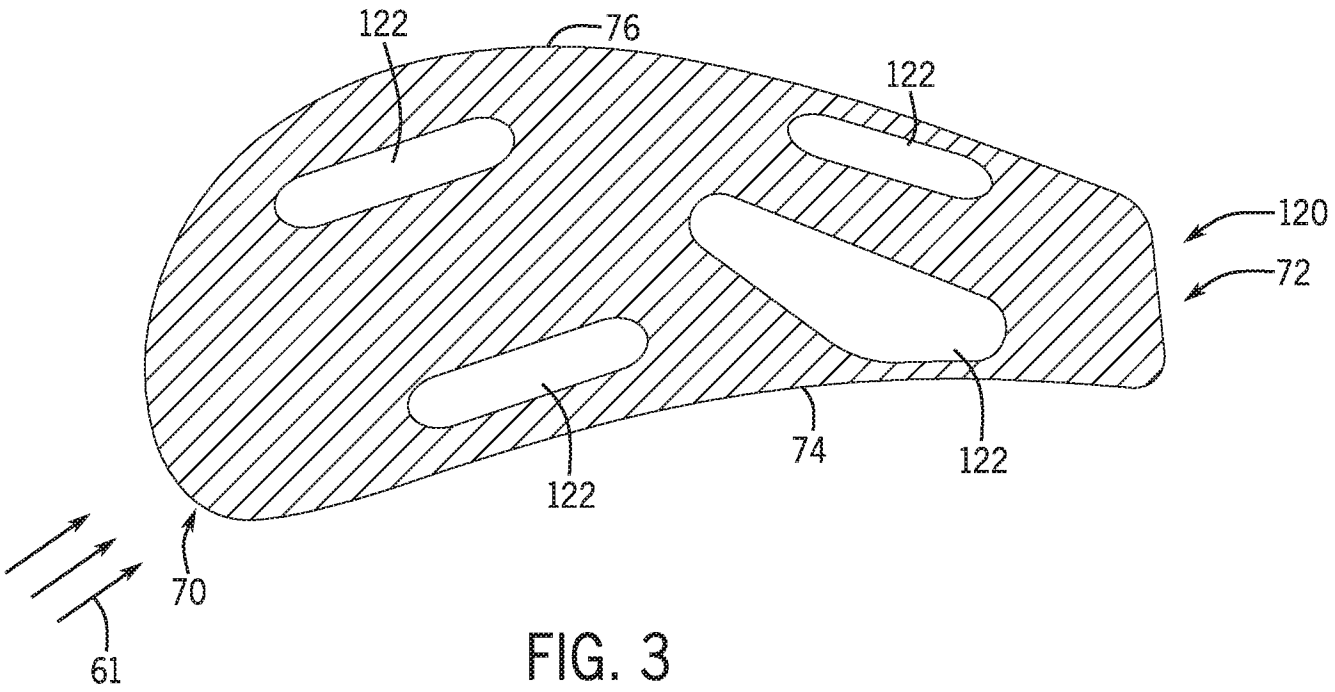
FIG. 3 is a top view of an embodiment of a circuit completion plate utilized with the turbine component of FIG. 2.

FIG. 3 illustrates a top view of a circuit completion plate 120 that may be utilized with the turbine component of FIG. 2. The circuit completion plate 120 forms radial coolant boundaries of the turbine component 32. The circuit completion plate 120 may be disposed on a radially inner end of the turbine component, a radially outer end of the turbine component, or both. Further, the circuit completion plate 120 includes flow channels 122 that allow the air to pass from one cooling cavity to another, thereby fluidly coupling the cooling cavities to one another. For example, one of the flow channels 122 may allow air to pass from the suction side source cavity to the second suction side cooling cavity and prevent the air from flowing to any other cooling cavities. By fluidly coupling the cooling cavities, the circuit completion plate 120 creates a fluid circuit out of the cooling cavities that allows the air to flow up and down the height of the turbine component in a serpentine path. The circuit completion plate 120 completes a serpentine flow path by enabling air to flow transverse to the height 33 of the turbine component 32 from one cooling cavity to another. The circuit completion plate 120 may include any number of flow channels 122, including 1, 2, 3, 4, 5, 6, or more, and the circuit completion plate 120 may fluidly couple any of the cooling cavities to any other cooling cavity. In some embodiments, the circuit completion plate 120 may fluidly couple multiple cooling cavities to one another. Further, in other embodiments, the circuit completion plate 120 may fluidly couple the impingement cavity to one or more of the cooling cavities. Further, in other embodiments, the circuit completion plate may fluidly couple cooling cavities from one turbine component to another turbine component, axially or radially.

Figure 4:
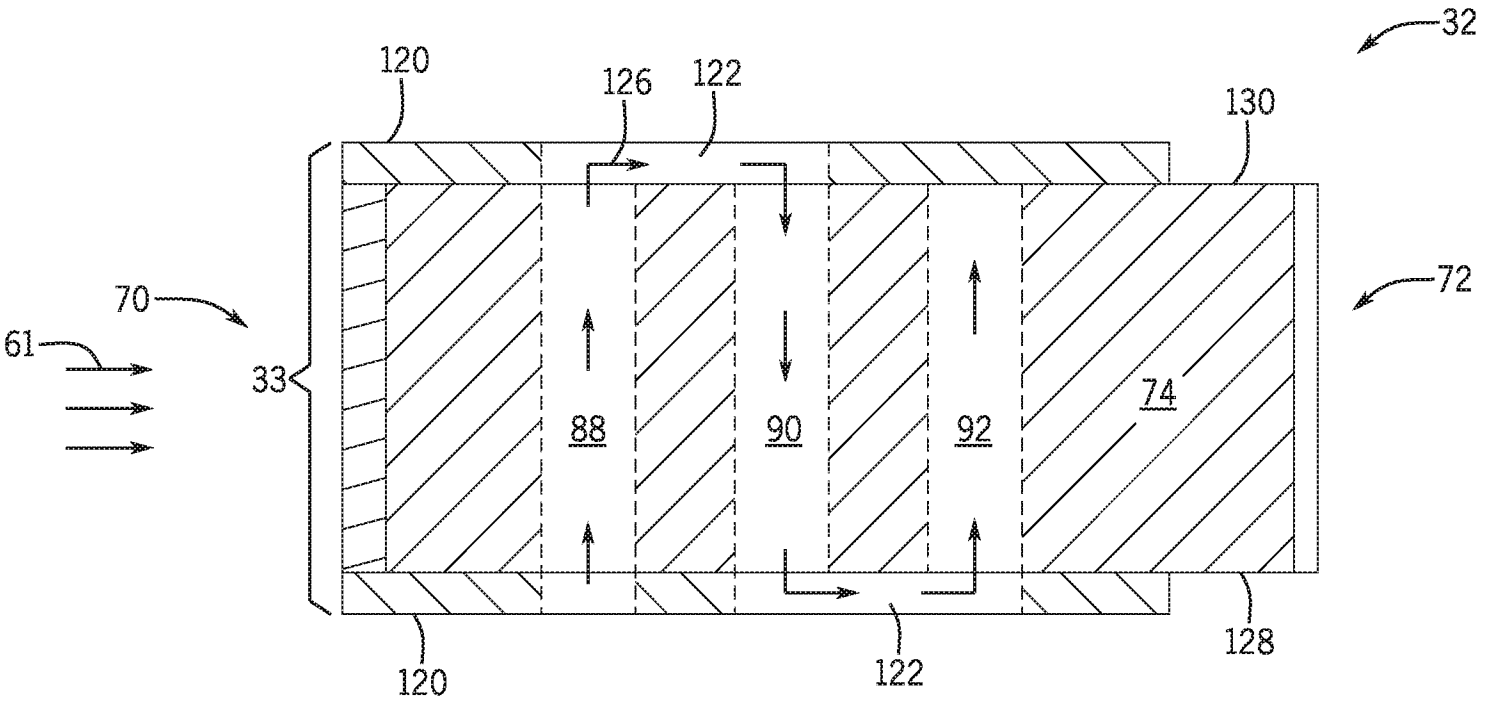
FIG. 4 is a side cross-sectional view of an embodiment of the turbine component of FIG. 2 with the circuit completion plate of FIG. 3.

FIG. 4 illustrates a side view of an embodiment of the turbine component 32 with the circuit completion plates 120. As discussed above, the turbine component 32 may include circuit completion plates 120 on a radially inner end 128 (e.g., end wall) and a radially outer end 130 (e.g., end wall). Further, the circuit completion plates 120 may be integral to the turbine component 32, or coupled to the turbine component (e.g., via welding, brazing, etc.). The pressure side near wall source cavity 88, the second pressure side near wall cooling cavity 90, and the third pressure side near wall cooling cavity 92 each extend the height 33 of the turbine component, and allow air 126 to flow through the turbine component 32. As illustrated, the circuit completion plates 120 allow the air 126 to flow from the pressure side near wall source cavity 88, through the flow channel 122, then through the second pressure side near wall cooling cavity 90, then through another flow channel 122, and then through the third pressure side near wall cooling cavity 92.

As the air flows through the cooling cavities, the air absorbs the heat from the surfaces within the cooling cavities, thereby lowering the temperature of the turbine component. The air is able to absorb less heat as the temperature of the air approaches the temperature of the turbine component and the combustion gases. Passing the air through multiple cavities before discharging the air enables the air to absorb more heat than if the air passes through only one cavity before discharging the air. Utilizing the air to absorb more heat enables the system to use less air for cooling purposes, thereby increasing the efficiency of the turbine system. Further, discharging the air at a higher temperature preserves the heat of the combustion gases, which also increases the efficiency of the turbine system.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A turbine airfoil, comprising:

a turbine component comprising:

a leading edge;

a trailing edge;

a pressure side wall extending between the leading edge and the trailing edge;

a suction side wall extending between the leading edge and the trailing edge;

a near wall source cavity disposed within the turbine component, wherein the near wall source cavity is configured to receive cooling air; and a second near wall cooling cavity disposed within the turbine component; and a first circuit completion plate disposed on a first end of the turbine component, wherein the circuit completion plate comprises a plurality of separate flow channels disposed in a first surface that abuts a second surface of the first end of the turbine component, and the first circuit completion plate is configured to fluidly couple the near wall source cavity to the second near wall cooling cavity via a first flow channel of the plurality of separate flow channels.

2. The turbine airfoil of claim 1, wherein the second near wall cooling cavity is fluidly coupled to an outer surface of the pressure side wall or the suction side wall of the turbine airfoil and is configured to provide film cooling around the turbine airfoil.

3. The turbine airfoil of claim 1, wherein the turbine component comprises a third near wall cooling cavity disposed within the turbine airfoil-, wherein the turbine airfoil comprises a second circuit completion plate at a second end of the turbine component opposite the first end, wherein the second circuit completion plate comprises a second flow channel disposed in a third surface that abuts a fourth surface of the second end of the turbine component, and the second circuit completion plate is configured to fluidly couple the second near wall cooling cavity to the third near wall cooling cavity via the second flow channel.

4. The turbine airfoil of claim 3, wherein the turbine component comprises a fourth near wall cooling cavity disposed within the turbine component, the plurality of separate flow channels of the first circuit completion plate comprises a third flow channel disposed in the first surface, and the first circuit completion plate is configured to fluidly couple the third near wall cooling cavity and the fourth near wall cooling cavity via the third flow channel.

5. The turbine airfoil of claim 4, wherein the near wall source cavity, the first flow channel, the second near wall cooling cavity, the second flow channel, the third near wall cooling cavity, the third flow channel, and the fourth near wall cooling cavity form a serpentine path for cooling air flow.

6. The turbine airfoil of claim 1, wherein the first circuit completion plate is coupled to the turbine component by brazing.

7. The turbine airfoil of claim 1, wherein the first circuit completion plate is made separately from the turbine component.

8. The turbine airfoil of claim 1, wherein the turbine component comprises an impingement cavity disposed within the turbine component adjacent to the leading edge, wherein the impingement cavity is configured to receive air from outside the turbine component through a plurality of diffuser holes disposed along the leading edge.

9. The turbine airfoil of claim 8, wherein the impingement cavity is fluidly coupled to an outer surface of the pressure side wall or the suction side wall and is configured to provide post-impingement air to provide film cooling around the turbine airfoil.

10. The turbine airfoil of claim 8, wherein the first circuit completion plate is configured to fluidly couple the impingement cavity to the near wall source cavity, the second near wall cooling cavity, or both.

11. The turbine airfoil of claim 1, wherein the near wall source cavity and the second near wall cooling cavity are adjacent to the pressure side wall, and the turbine component comprises a suction side near wall source cavity disposed within the turbine component wherein the suction side near wall source cavity is configured to receive cooling air, and a second suction side near wall cooling cavity disposed within the turbine component, wherein the suction side near wall source cavity and the second suction side near wall cooling cavity are adjacent to the suction side wall.

12. The turbine airfoil of claim 11, wherein the first circuit completion plate is configured to fluidly couple the suction side near wall source cavity and the second suction side near wall cooling cavity via a second flow channel of the plurality of separate flow channels.

13. A turbine airfoil, comprising:

a turbine component comprising:

a leading edge;

a trailing edge;

a pressure side wall extending between the leading edge and the trailing edge;

a suction side wall extending between the leading edge and the trailing edge;

a pressure side near wall source cavity disposed within the turbine component, wherein the pressure side near wall source cavity is configured to receive cooling air;

a second pressure side near wall cooling cavity disposed within the turbine component, wherein the pressure side near wall source cavity and the second pressure side near wall cooling cavity are adjacent to the pressure side wall;

a suction side near wall source cavity disposed within the turbine component, wherein the suction side near wall source cavity is configured to receive cooling air;

a second suction side near wall cooling cavity disposed within the turbine component, wherein the suction side near wall source cavity and the second suction side near wall cooling cavity are adjacent to the suction side wall; and a circuit completion plate disposed on a first end of the turbine component, wherein the circuit completion plate comprises first and second flow channels disposed separate from one another in a first surface that abuts a second surface of the first end of the turbine component, the circuit completion plate is configured to fluidly couple the pressure side near wall source cavity to the second pressure side near wall cooling cavity via the first flow channel, and the circuit completion plate is configured to fluidly couple the suction side near wall source cavity to the second suction side near wall cooling cavity via the second flow channel.

14. The turbine airfoil of claim 13, wherein the second pressure side near wall cooling cavity is fluidly coupled to an outer surface of the pressure side wall of the turbine airfoil and is configured to provide film cooling around the turbine airfoil, and the second suction side near wall cooling cavity is fluidly coupled to an outer surface of the suction side wall of the turbine airfoil and is configured to provide film cooling around the turbine airfoil.

15. The turbine airfoil of claim 13, wherein the circuit completion plate is coupled to the turbine component by brazing.

16. The turbine airfoil of claim 13, wherein the turbine component comprises an impingement cavity disposed within the turbine component adjacent to the leading edge, wherein the impingement cavity is configured to receive air from outside the turbine component through a plurality of diffuser holes disposed along the leading edge.

17. The turbine airfoil of claim 16, wherein the impingement cavity is fluidly coupled to an outer surface of the pressure side wall or the suction side wall and is configured to provide post-impingement air to provide film cooling around the turbine airfoil.

18. A turbine airfoil, comprising:

a turbine component comprising:

a leading edge;

a trailing edge;

a pressure side wall extending between the leading edge and the trailing edge;

a suction side wall extending between the leading edge and the trailing edge;

a near wall source cavity disposed within the turbine component, wherein the near wall source cavity is configured to receive cooling air;

a plurality of near wall cooling cavities disposed within the turbine component, the plurality of near wall cooling cavities comprising a first near wall cooling cavity, a second near wall cooling cavity, and a third near wall cooling cavity;

a first circuit completion plate disposed on a first surface of a first end of the turbine component, wherein the first circuit completion plate comprises first and third flow channels disposed separate from one another in a second surface that abuts the first surface of the first end of the turbine component, the first circuit completion plate is configured to fluidly couple the near wall source cavity to the first near wall cooling cavity via the first flow channel, and the first circuit completion plate is configured to fluidly couple the second near wall cooling cavity to the third near wall cooling cavity via the third flow channel; and a second circuit completion plate disposed on a third surface of a second end of the turbine component opposite the first end, wherein the second circuit completion plate comprises a second flow channel disposed in a fourth surface that abuts the third surface of the second end of the turbine component, and the second circuit completion plate is configured to fluidly couple the first near wall cooling cavity to the second near wall cooling cavity via the second flow channel, wherein the cooling air flows through the near wall source cavity, the first flow channel, the first near wall cooling cavity, the second flow channel, the second near wall cooling cavity, the third flow channel, and the third near wall cooling cavity in a serpentine path.

19. The turbine airfoil of claim 18, wherein the turbine component comprises an impingement cavity disposed within the turbine component adjacent to the leading edge, wherein the impingement cavity is configured to receive air from outside the turbine component through a plurality of diffuser holes disposed along the leading edge.

20. The turbine airfoil of claim 19, wherein the impingement cavity is fluidly coupled to an outer surface of the pressure side wall or the suction side wall and is configured to provide post-impingement air to provide film cooling around the turbine airfoil.

* * * * *